US007491066B1

(12) United States Patent
Chen

(10) Patent No.: US 7,491,066 B1
(45) Date of Patent: Feb. 17, 2009

(54) PATCH PANEL

(75) Inventor: Fei-Hsu Chen, Taipei Hsien (TW)

(73) Assignee: Foxnum Technology Co., Ltd., Tucheng, Taipei County (TW)

( * ) Notice: Subject to any disclaimer, the term of this patent is extended or adjusted under 35 U.S.C. 154(b) by 0 days.

(21) Appl. No.: 11/967,067

(22) Filed: Dec. 29, 2007

(30) Foreign Application Priority Data

Dec. 25, 2007 (CN) ..... 2007 1 0203394

(51) Int. Cl.
*H01R 29/00* (2006.01)

(52) U.S. Cl. ..... 439/49

(58) Field of Classification Search ..... 439/540.1, 439/701, 532, 49
See application file for complete search history.

(56) References Cited

U.S. PATENT DOCUMENTS 1,393,822 A * 10/1921 Parker ..... 439/189
3,456,231 A * 7/1969 Zimmerman, Jr. et al. .. 439/532
5,038,004 A * 8/1991 Ohashi ..... 200/16 C
6,371,773 B1 * 4/2002 Crofoot et al. ..... 439/79
6,386,924 B2 * 5/2002 Long ..... 439/701
6,527,409 B1 * 3/2003 Naghi et al. ..... 362/186
6,540,522 B2 * 4/2003 Sipe ..... 439/61
6,835,081 B2 * 12/2004 Plattner et al. ..... 439/215
7,297,031 B2 * 11/2007 Leddy ..... 439/701

* cited by examiner

*Primary Examiner*—Neil Abrams
*Assistant Examiner*—Phuong Nguyen
(74) *Attorney, Agent, or Firm*—Frank R. Niranjan

(57) ABSTRACT

A patch panel includes a plurality of signal input terminals, an output module having a plurality of signal output terminals and at least one standby signal output terminal, and an adapter module having a slide board and a plurality of sliding blocks slidably mounted on the slide board. Each of the sliding blocks includes an electrical contact mounted thereon and connected to a corresponding signal input terminal. The slide board includes a plurality of electrical terminals mounted thereon and respectively connected to the signal output terminals of the at least one standby signal output terminal. The electrical contacts of the sliding blocks selectively electrically contact the electrical terminals of the slide board by sliding of the sliding blocks from an initial position to another position.

5 Claims, 5 Drawing Sheets

PATCH PANEL

BACKGROUND

Field of the Invention

The present invention relates to patch panels.

2. Description of Related Art

Generally speaking, after a printed circuit board (PCB), such as a motherboard, is assembled, it needs to be tested via a patch panel and a tester.

Referring to FIG. 1, a conventional patch panel is shown. The patch panel includes a connector 100 having nine signal input terminals 120, and an output module 200 having nine signal output terminals 220 and two standby signal output terminals 240. The nine signal input terminals 120 are respectively connected to the nine signal output terminals 220. When a motherboard needs to be tested, a tester is connected to the connector 100 via the connector of the tester, and a plurality of test pins of the motherboard are respectively connected to a plurality of the signal output terminals 220, and then the tester will test the motherboard via the patch panel.

When a connecting line of the patch panel is broken, an extra connecting line is used to connect the unconnected input terminal 120 to a standby output terminal 240. However, with this method, the extra connecting line must be welded to the unconnected input terminal 120 and the standby output terminal 240, which is very inconvenient and may damage the patch panel.

What is needed is to provide a patch panel which overcomes the above problems.

SUMMARY

An embodiment of a patch panel includes a plurality of signal input terminals, an output module having a plurality of signal output terminals and at least one standby signal output terminal, and an adapter module having a slide board and a plurality of sliding blocks slidably mounted on the slide board. Each of the sliding blocks includes an electrical contact mounted thereon and connected to a corresponding signal input terminal. The slide board includes a plurality of electrical terminals mounted thereon and respectively connected to the signal output terminals of the at least one standby signal output terminal. The electrical contacts of the sliding blocks selectively electrically contact the electrical terminals of the slide board by sliding of the sliding blocks from an initial position to another position.

Other advantages and novel features of the present invention will become more apparent from the following detailed description of an embodiment when taken in conjunction with the accompanying drawings, in which:

DETAILED DESCRIPTION

Figure 1:
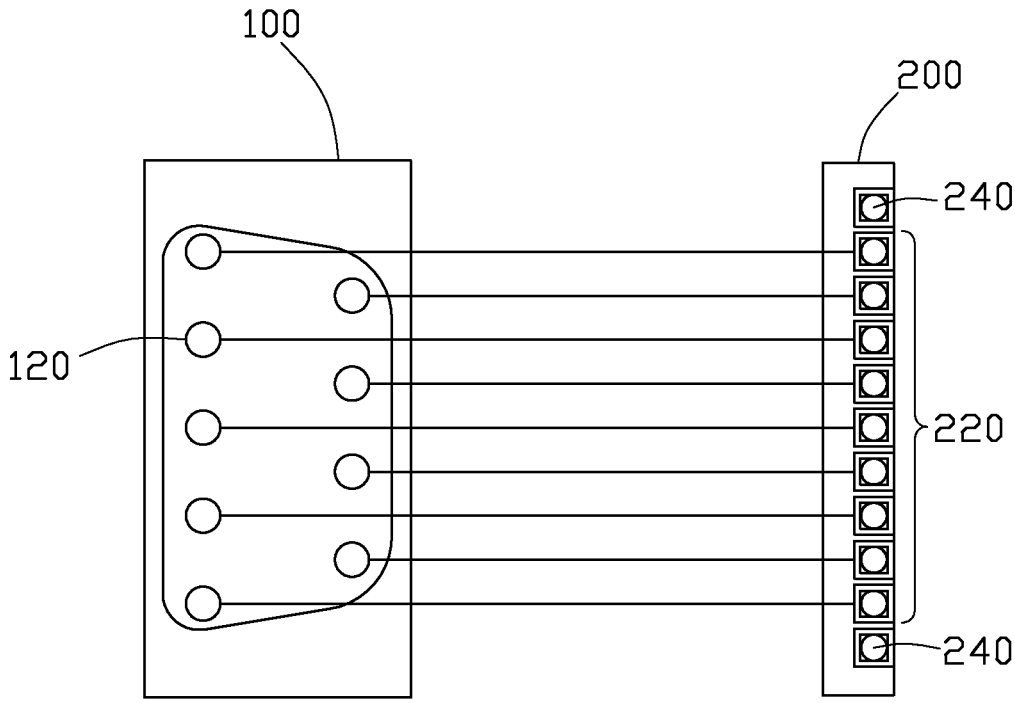
FIG. 1 (RELATED ART)
FIG. 1 is a schematic view of a conventional patch panel.
Figure 2:
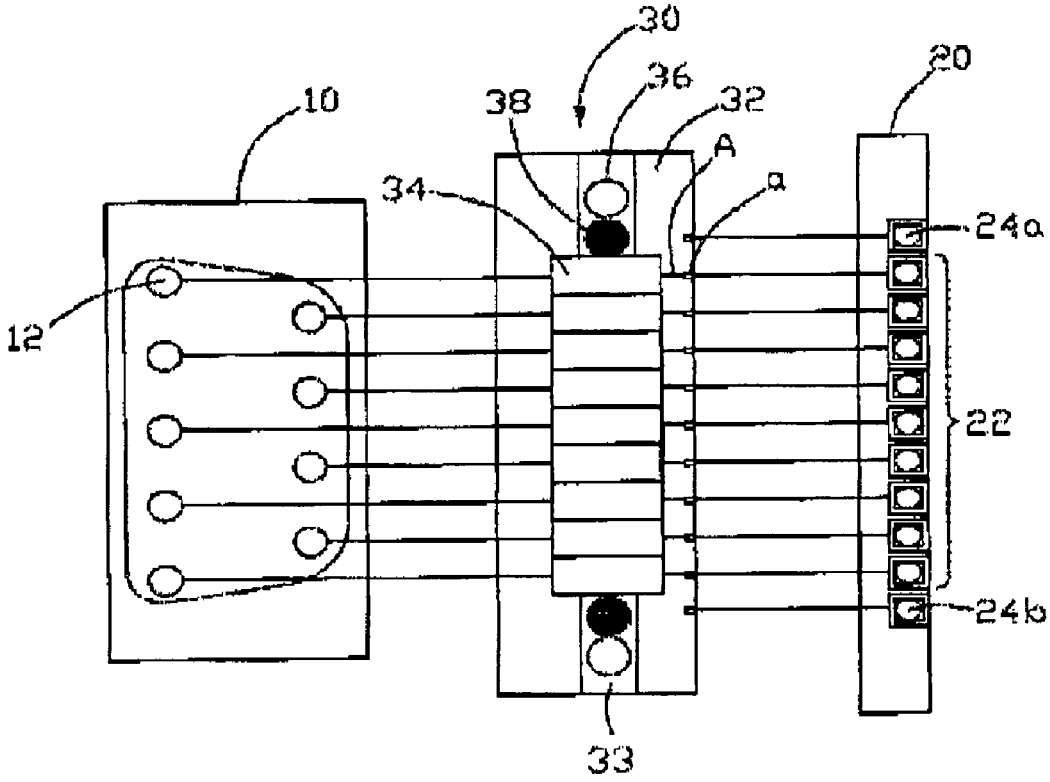
FIG. 2 is a schematic view of a patch panel in accordance with an embodiment of the present invention.
Figure 3:
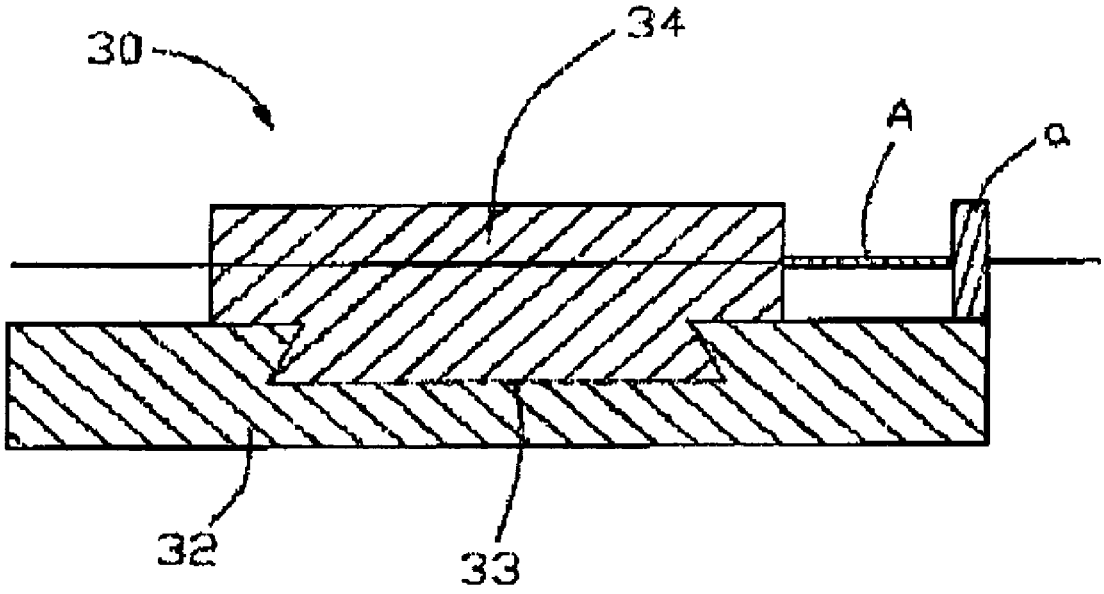
FIG. 3 is a cross-section view of an adapter module of the patch panel of FIG. 2.

Referring to FIGS. 2 to 3, a patch panel in accordance with an embodiment of the present invention includes a connector 10, an output module 20, and an adapter module 30. The connector 10 includes nine signal input terminals 12. The output module 20 includes nine signal output terminals 22 and two standby signal output terminals 24*a* and 24*b*. The adapter module 30 includes a slide board 32 and nine sliding blocks 34. In other embodiments, the amount of the signal input terminals 12, the signal output terminals 22, the standby signal output terminals 24*a* and 24*b*, and the sliding blocks 34 can be changed according to need.

The sliding blocks 34 are slidably mounted on the slide board 32 side by side via a groove 33, which has a dovetail configuration (shown in FIG. 3). The right end of each slide block 34 includes an electrical contact "A" mounted thereon and connected to a corresponding signal input terminal 12 of the connector 10. The right side of the slide board 32 includes eleven electrical terminals "a" mounted thereon and respectively connected to the signal output terminals 22, and the standby signal output terminals 24*a*, 24*b*. In this embodiment, the slide board 32 defines a plurality of locating holes 36 therein. When the sliding blocks 34 are slidably moved on the slide board 32, the electrical contacts "A" of the sliding blocks 34 will electrically contact the electrical terminals "a" of the slide board 32, which can make the signal input terminal 12 electrically connect to the signal output terminals 22 or the standby signal output terminals 24*a* and 24*b* correspondingly.

In use, if all connecting lines of the patch panel are good, each of the sliding blocks 34 is located at an initial position on the slide board 32 (shown in FIG. 2). At this time, the signal input terminals 12 are respectively electrically connected to the signal output terminals 22 via the adapter module 30. And two locating posts 38 are respectively inserted into two corresponding locating holes 36 to locate the sliding blocks 34 on the slide board 32, and the patch panel works normally.

Figure 4:
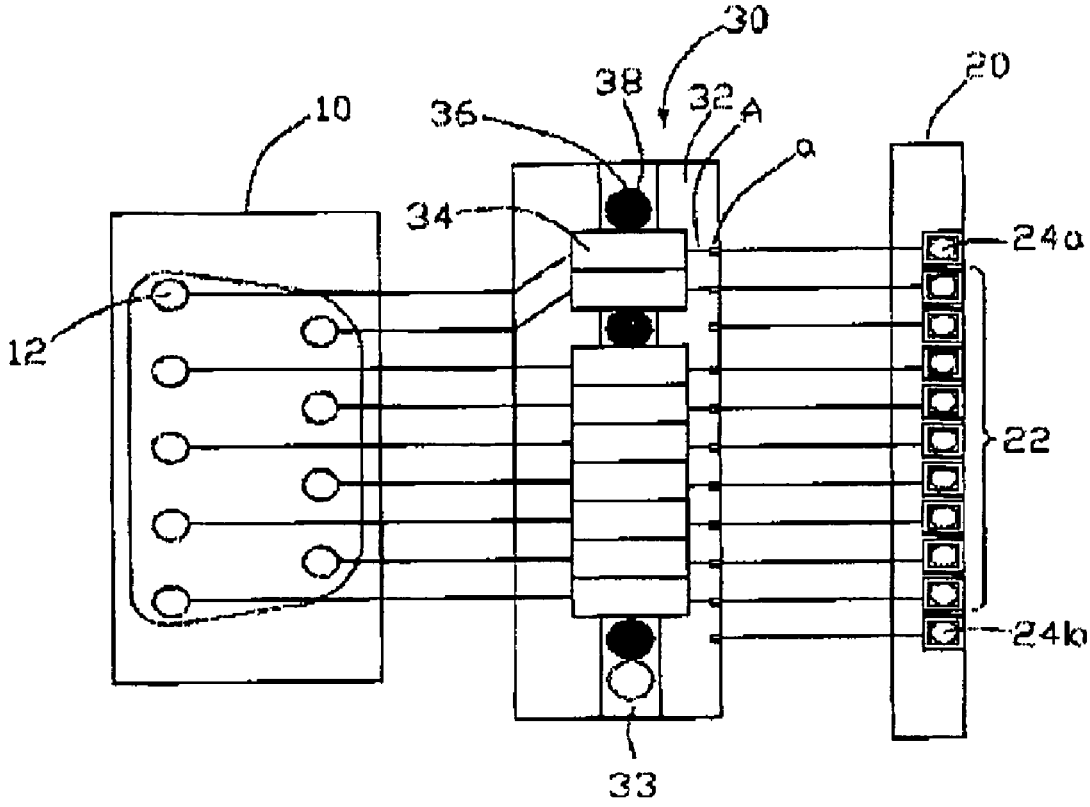
FIG. 4 is a schematic view of the patch panel of FIG. 2 when two sliding blocks thereof are slid to another position.

Referring also to FIG. 4, if one connecting line of the patch panel is broken, a corresponding slide block 34 is manually slid to another position to make the electrical contact "A" thereof electrically contact another electrical terminal "a" of the slide board 32 which connected to another signal output terminal 20. And the last positional block 34 of one end of the slide board 32 is slid to another position to make the electrical contact "A" thereof electrically contact another electrical terminal "a" of the slide board 32, which is connected to the standby signal output terminal 24*a*. And three locating posts 38 are respectively inserted into three corresponding locating holes 36 to locate the sliding blocks 34 on the slide board 32. Thereby, the patch panel can work normally again, which is very convenient.

Figure 5:
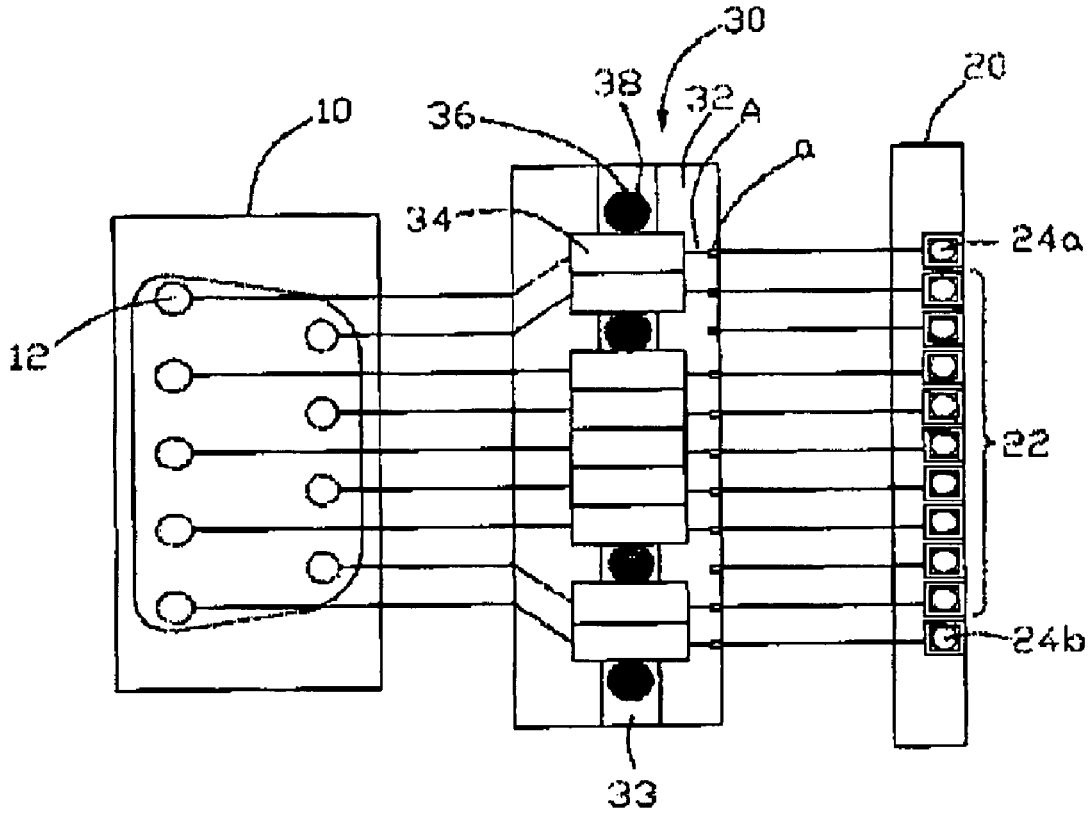
FIG. 5 is a schematic view of the patch panel of FIG. 2 when four sliding blocks thereof are slid to another position.

Referring also to FIG. 5, if two connecting lines of the patch panel are broken, two corresponding sliding blocks 34 are manually slid to another position to make the electrical contacts "A" thereof electrically contact another electrical terminals "a" of the slide board 32 which connected to the another signal output terminals 20. And the last positional blocks 34 of two ends of the slide board 32 are slide to another position to make the electrical contacts "A" thereof electrically contact another electrical terminals "a" of the slide board 32 which respectively connected to the standby signal output terminals 24*a* and 24*b*. And four locating posts 38 are respectively inserted into four corresponding locating holes 36 to locate the sliding blocks 34 on the slide board 32. Thereby, the patch panel can work normally again, which is very convenient.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A patch panel comprising:

N signal input terminals, wherein N is an integer greater than one;

an output module having N signal output terminals and at least one standby signal output terminal, each of the at least one standby signal output terminals capable of replacing one of the signal output terminals when one of the signal output terminals cannot be used; and an adapter module having a slide board and N sliding blocks, the sliding blocks capable of being slid parallel to and at least partially inside the slide board via a groove defined in the slide board, each of the sliding blocks comprising an electrically contact mounted on one end thereof and connected to a corresponding signal input terminal via another end thereof, the slide board comprising a plurality of electrical terminals mounted thereon and respectively connected to the signal output terminals and the at least one standby signal output terminal, the electrical contacts of the sliding blocks capable of selectively electrically contacting the electrical terminals of the slide board by sliding of the sliding blocks from an initial connection position to another connection position in the groove;

wherein the electrical contacts of the sliding blocks and the electrical terminals are exposed out of the slide board.

2. The patch panel as claimed in claim 1, wherein the groove of the slide board has a dovetail cross-section, and the sliding blocks each have a dovetail cross-section to complement the groove.

3. The patch panel as claimed in claim 1, wherein the amounts of the signal input terminals, the signal output terminals, and the sliding block are the same.

4. The patch panel as claimed in claim 1, wherein the amount of the at least one standby output terminal are two.

5. The patch panel as claimed in claim 1, wherein the slide board defines a plurality of locating holes therein and at least two locating posts are inserted into at least two corresponding locating holes to locate the sliding blocks.

* * * * *